United States Patent [19]

Hanyu et al.

[11] Patent Number: 4,620,810

[45] Date of Patent: Nov. 4, 1986

[54] SOUND PROOF DEVICE OF A PRINTER

[75] Inventors: Susumu Hanyu; Hideaki Takenoya, both of Tokyo; Kazuyuki Saiki, Chofu, all of Japan

[73] Assignee: Janome Sewing Machine Co. Ltd., Tokyo, Japan

[21] Appl. No.: 647,131

[22] Filed: Sep. 4, 1984

[30] Foreign Application Priority Data

Sep. 7, 1983 [JP] Japan ..... 58-163289

[51] Int. Cl.[4] ..... B41J 29/08

[52] U.S. Cl. ..... 400/689; 400/618; 400/636

[58] Field of Search ..... 400/689, 618, 636, 690, 400/690.1, 690.2, 690.3, 690.4

[56] References Cited

U.S. PATENT DOCUMENTS 1,981,034 11/1934 Gabrielson ..... 400/689
4,197,024 4/1980 Huntoon ..... 400/689 X
4,215,946 8/1980 Nakabo et al. ..... 400/689
4,465,390 8/1984 Zander ..... 400/689

FOREIGN PATENT DOCUMENTS 55-133982 10/1980 Japan ..... 400/689
423845 2/1935 United Kingdom ..... 400/689

OTHER PUBLICATIONS

"Noise Reduction Feature for Typewriters", W. F. Irving, *IBM Technical Disclosure Bulletin,* vol. 18, No. 7, Dec. 1975.

*Primary Examiner*—William Pieprz
*Assistant Examiner*—Moshe I. Cohen
*Attorney, Agent, or Firm*—Michael J. Striker

[57] ABSTRACT

With respect to a printer which carries out printing on a paper by impact of a wire of a printing head repeating movement, a sound proof device of a printer prevents the paper from transmitting fluttering under amplification to the paper sent to an entrance of the printer, and does not cause inconvenience to sending of the paper.

5 Claims, 7 Drawing Figures

FIG_4
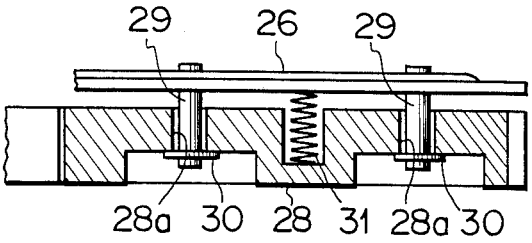
FIG_5
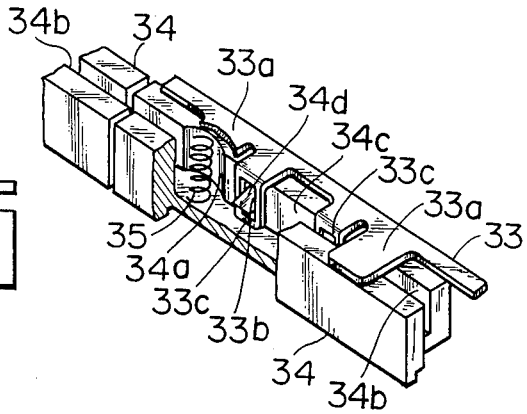
FIG_6
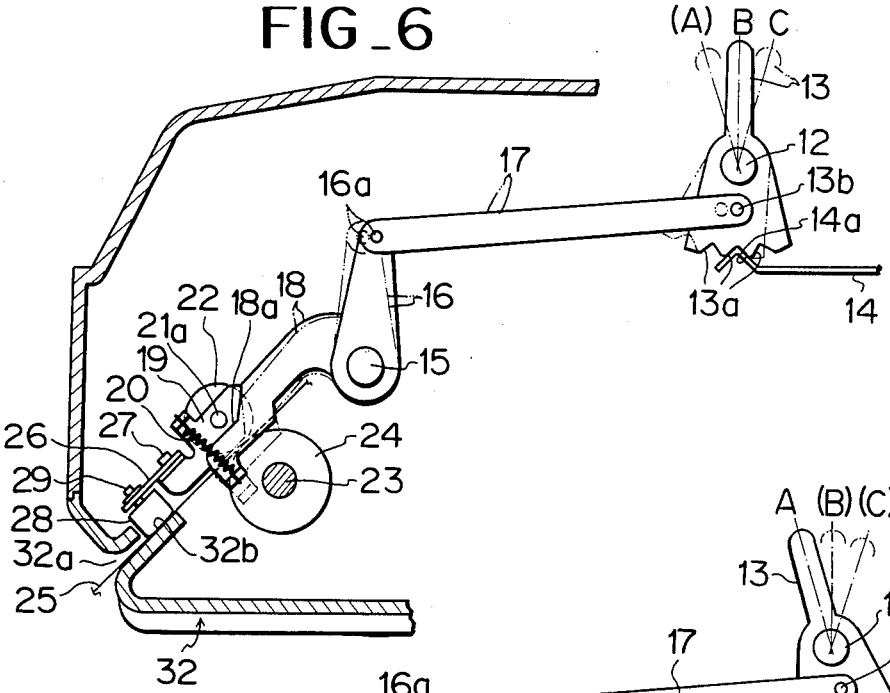
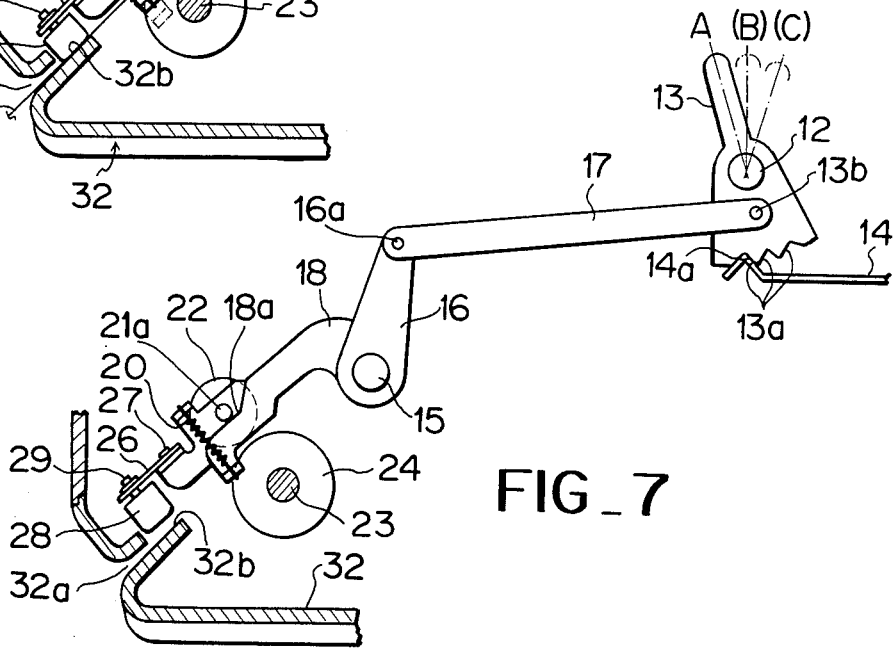
FIG_7

SOUND PROOF DEVICE OF A PRINTER

FIELD OF THE INVENTION

This invention relates to a sound proof device of a printer, in which a sound proof block is provided at an entrance of a printing paper, thereby reducing noise caused by fluttering of the printing paper.

BACKGROUND OF THE INVENTION

There is a kind of printer which carries out printing on a paper by repetitive impact movement of a wire of a printing head. This kind of printer is roughly divided into two types. In one type the printing paper and an ink ribbon are guided between a platen and the printing head, and the printing is performed by pressing the printing head to contact the ink ribbon to the paper. In the second type the printing paper is guided between an ink containing platen and the printing head, and the printing is performed by pressing the printing head to contact the platen to the paper.

In these two types of the printers, a problem is noises which are caused by impact of the wire of the printing head. Unless the paper is secured to a position near to an end of the printing head, for example, unless the paper is coiled on the platen at a certain determined tension and at satisfactory angle, each part of the mechanism is vibrated by said impact and the paper flutters, and this vibration and fluttering is transmitted under amplification to the printing paper sent to the entrance of the printer with a result of causing large noises.

An explanation will be made with reference to the second of the two types, shown in FIG. 1. The printing paper is sent from an entrance 1*a* of a base 1, kept between a paper send roller 3 and a paper press roller 4, guided along a guide 5, passed through between an ink containing platen 6 and an end 7*a* of a printing head 7 in a non-contacting manner, guided along a guide plate 8 and a tractor 9, and led outside of a cover 10.

This type cannot guide the printing paper 2 in contacting the platen 6. When printing, the paper 2 is firmly secured at a position near to the end 7*a* of the head 7.

SUMMARY OF THE INVENTION

With respect to a printer which carries out printing on the paper by impact of the wire of the printing head repeating movement, it is an object of the present invention to provide a sound proof device of a printer, which prevents the printing paper from transmitting fluttering under amplification on the paper sent to the entrance of the printer, and does not cause inconvenience to sending of the paper subsequently to printing, and easily sends the paper from the entrance by the switching operation.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 2 to 7 relate to embodiments of the invention, in which

FIG. 2 is a plan view showing major parts concerning the invention, omitting a cover and a base from the printer;

FIG. 3 is a perspective view of an element part of the sound proof device;

FIG. 4 is a cross sectional view showing a holding plate and a sound proof block seen from an arrow D in FIG. 3;

FIG. 5 is a perspective and cross sectional view showing a sound proof block and a holding plate of the other embodiment;

FIG. 6 is a cross sectional view showing two operations for printing and sending the paper; and FIG. 7 is a cross sectional view showing an operation for sending the paper.

DETAILED DESCRIPTION OF THE PREFERRED EMBODIMENTS

Figure 1:
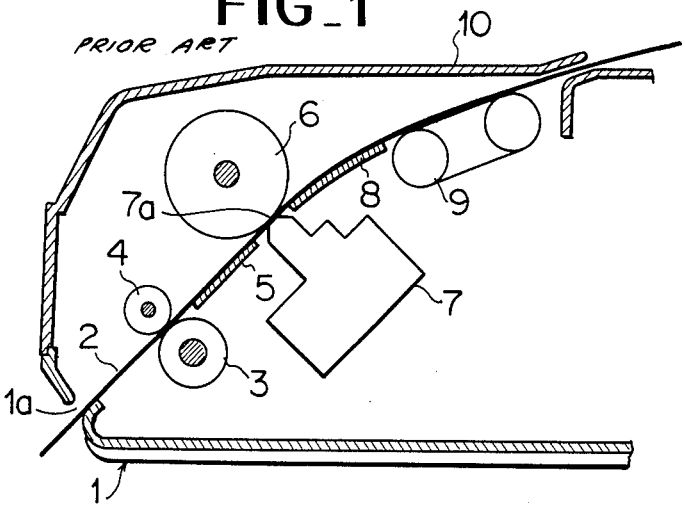
FIG 1 PRIOR ART
FIG. 1 is a cross sectional view showing outlined positions of a paper sending mechanism and a printing mechanism of an existing printer.
Figure 2:
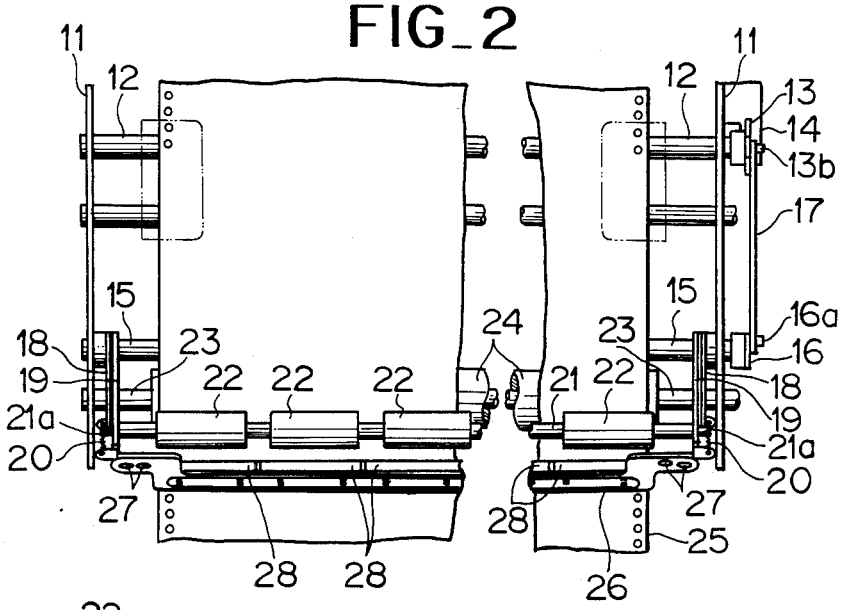
Figure 3:
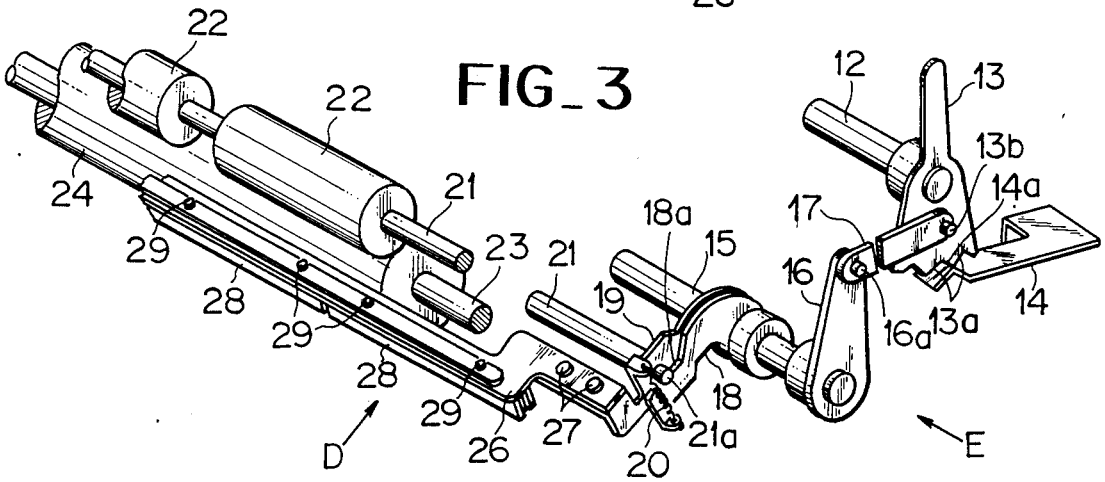

The invention will be explained with reference to embodiments shown in the attached drawings. In FIGS. 2 and 3, a tractor shaft 12 is supported on a machine frame 11, and a switch lever 13 is rotatably supported on the tractor shaft 12. The switch level 13 is defined with a plurality of engaging portions 13*a*, one of which is engaged with a convex portion 14*a* of a plate spring 14.

A guide shaft 15 is rotatably supported on the machine frame 11 and is secured with a lever 16 which is connected to the switch lever 13 via a pin 16*a*, a connecting plate 17 and a pin 13*b*. The guide shaft 15 is rotatably supported with pairs of second actuating arms 19 at left and right portions. A tension spring 20 is provided between a first actuating arm 18 and the second actuating arm 19.

A roller shaft 21 rotatably holds a plurality of paper pressing rollers 22, and is supported at its both ends by pairs of the second actuating arms 19 from which projections 21*a* are formed.

A roller drive shaft 23 is fixed with a paper send roll-24, to which the paper pressing rollers 22 are contacted via a printing paper 25. In a solid lined condition (called as "B condition") and a two dotted lined condition (called as "C condition") illustrated in FIG. 6, the projection 21*a* of the roller shaft 21 faces toward a working face 18*a* of the first actuating arm 18 with a slight space there between.

A holding plate 26 is secured with screws 27 to the end of the second actuating arm 19, and is provided with a plurality of resin made sound proof blocks 28.

As is seen in FIG. 4, a pin 29 secured in the holding plate 26 goes into a hole 28*a* of the sound proof block 28, and is held by a stopper ring 30. A weak compression spring 31 is provided between the holding plate 26 and the sound proof block 28.

In the B and C conditions shown in FIG. 6, the sound proof block 28 is non-contacted to a lower face of the holding plate 26, and also to an upper face of the stopper ring 30. The printing paper 25 is guided to a paper guiding part 32*b* of an entrance 32*a* of a base 32, and is pressed here due to force of the weak compression spring 31 and the weight of the sound proof block 28.

The sound proof block 28 is divided into parts in the printing width for the reason that printing papers of various sizes are made smalller in width than the maximum available printing width, so that pressing force of the sound proof block 28 is made effective to the printing width.

Instead of the holding plate 26 and the sound proof block 28 as shown in FIG. 4, those shown in FIG. 5 may be employed. In FIG. 5, a holding plate 33 is provided with a plurality of resin made sound proof blocks 34 approximately U shaped in cross section. The holding plate 33 is formed with bent portions 33*c* having spring receipts 33*a* and square holes 33*b*. The sound proof block 34 is provided with a pair of spring seats 34*a* (one of which is shown), and an inner wall 34*c* of a groove 34*b* is provided with a pair of projections 34*d* (one of which is shown).

The sound proof block 34 and the holding plate 33 are set up by setting a compression spring 35 to the spring seat 34*a*, setting the bent portion 33*c* of the holding plate 33 in the groove 34*b* of the sound proof block 34, passing under elastic deformation the bent portion 33*c* at its end through a narrow space defined between an end portion of the projection 34*d* and the wall of the groove 34*b*, and making engagement between the projection 34*d* and the square hole 33*b*.

After having set the sound proof block 34 to the holding plate 33, the sound proof block 34 is non-contacted to the lower face of the holding plate 33 and also to the lower side of the square hole 33*b* in the B and C conditions similarly to the embodiment shown in FIG. 4. The sound proof block 34 contacts the base 32 via the printing paper 25 due to the force of the weak compression spring 35 and the weight of the sound proof block 34.

Working of the embodiments of this invention will next be explained. When the switch lever 13 is rotated in the counterclockwise direction against the force of the plate spring 14 from the B position shown with the solid line in FIG. 6 or the C position shown with two-dotted line to the A position shown in FIG. 7, the lever 16 is rotated in the clockwise direction in association with the first actuating arm 18 via the pin 13*b*, the connecting plate 17 and the pin 16*a*. During rotation of the actuating arm 18 in the clockwise direction, the working face 18*a* contacts the projection 21*a*, and subsequently the actuating arm 18 is rotated in association with the second actuating arm 19 in the clockwise direction, and the paper press roller 22 is separated from the paper feed roller 24 via the roller shaft 21, while the sound proof block 28 provided to the holding plate 26 is separated from the paper guide 32*b* via the pin 29 and the stopper ring 30, as seen in FIG. 7. The printing paper 25 can be easily introduced into the entrance 32*a* under this condition.

When the paper 25 is fed into the entrance 32*a*, and the switch lever 13 is rotated in the clockwise direction from the A position shown in FIG. 7 against the plate spring 14 to the B position in FIG. 6, the lever 16 is rotated in accompanyment with the first actuating arm 18 in the counterclockwise direction via the pin 13*b*, the connecting plate 17 and the pin 16*a*. During rotation of the first actuating arm 18 in the counterclockwise direction, this arm 18 accompanies the second actuating arm 19 under a condition that the working face 18*a* is contacted to the projection 21*a* due to the weight of the paper pressing roller and the force of the tension spring 20. On the other hand, when the paper pressing roller 22 is contacted to the base 32 via the paper send roller 24 and the paper 25, the first actuating arm 18 solely rotates in the counterclockwise direction and comes to the B condition shown with the solid line in FIG. 6 while the arm 18 leaves the second actuating arm 19 there expanding the tension spring 20.

In the B condition shown with the solid line in FIG. 6, the printing paper 25 is slightly pressed to the paper send roller 24 due to the weight of the plurality of the paper press rollers 22 and the force of the tension spring 20, and gives slight tension to the printing paper 25 guided between a tractor (not shown) and the paper send roller 24. The sound proof block 28 is, as mentioned above, non-contacted to the lower face of the holding plate 26 and also non-contacted to the upper face of the stopper ring 30, and presses the paper 25 guided to a paper guide 32*b* of the base 32 due to the force of the weak compression spring 31 and the weight of the sound proof block 28 and closes the entrance 32*a*.

When the switch lever 13 is rotated from the B position in FIG. 6 in the clockwise direction against the plate spring 14 to the C condition, the lever 16 rotates in the counterclockwise direction in accompanyment with the first actuating arm 18 via the pin 13*b*, the connecting plate 17 and the pin 16*a*. During this rotation, the second actuating arm 19 is checked from rotating by the paper send roller 24 via the paper press roller 22 and the roller shaft 21, and the first actuating arm 18 is rotated to the two-dotted lined position in FIG. 6 while expanding the tension spring 20 from the B condition.

Comparing the B condition and the C condition in FIG. 6, the sound proof block 28 presses the paper 25 guided to the paper guide 32*b* of the base 32 due to the force of the weak compression spring 31 and the weight of the sound proof block 28 and closes the entrance 32*b*. With respect to the contacting force between the paper press roller 22 and the paper send roller 24, the C condition is stronger than the B condition by amount of expanding the tension spring 20. In the B condition, the printing paper 25 has sprocket holes and this condition is suitable to use of continuous slips to be sent by a pin belt of the tractor (not shown), while in the C condition the printing paper 25 does not have the sprocket holes and this condition is suitable to use of single slips to be sent by friction of the tractor.

In these conditions, the printing paper 25 is slightly pressed to the paper send roller 24 by the weight of the plurality of the paper press rollers 22 and the force of the tension spring 20, and give slight tension to the printing paper 25 guided between the tractor and the paper send roller, so the fluttering of the paper is made less. Since the sound proof block 28 slightly contacts the paper as said above, it does not hinder sending of the paper. Further, since the sound proof block 28 closes the entrance 32*a*, the noises do not get outside and are reduced significantly in comparison with prior printers.

As was mentioned above, with respect to the printer which carries out printing on the paper by impact of the wire of the printing head repeating movement, this invention is to provide the sound proof device of the printer, which prevents the printing paper from transmitting fluttering under amplification to the paper sent to the entrance of the printer, and does not cause inconvenience to sending of the paper subsequent to printing.

While the invention has been illustrated and described as embodied in a printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sound proof device of a printer having a platen, a printing head with printing wires selectively operated to impact the platen through a printing paper extended between the platen and the printing head to thereby print characters on the printing paper, the printing paper being supplied to a printing position from a paper inserting opening formed at a printer housing as the printing paper is transported by a transporting device including friction rollers operated to frictionally feed the printing paper to the printing position, the friction rollers being movable between an operative position in which the friction rollers frictionally clamp the printing paper to feed the latter to the printing position and an inoperative position in which the friction rollers are set apart to be ready to clamp the printing paper, the device comprising a guide provided at said paper inserting opening of said housing for guiding said printing paper toward said friction rollers; sound proof block means operatively connected to said friction rollers and movable in association with said friction rollers between an operative position in which said sound proof block means rests on said guide and closes said paper inserting opening of said printer housing and an inoperative position in which said sound proof block means is spaced from said guide and opens said paper inserting opening of said printer housing; and operating means when operated to a first position moving said friction rollers to said operative position thereof and simultaneously moving said sound proof block means in association with said friction rollers to said operative position thereof, said operating means when operated to a second position moving said friction rollers to said inoperative position thereof and simultaneously moving said sound proof block means in association with said friction rollers to said inoperative position thereof.

2. A sound proof device of a printer as defined in claim 1, wherein said operating means includes a spring which is operated to give a predetermined amount of pressure to said friction rollers in said operative position thereof.

3. A sound proof device of a printer as defined in claim 2, wherein said spring is operated to give a stronger pressure to said friction roller in said operative position thereof in a third operative position of said operating means, said spring being operated to press said sound proof block means against said guide with a predetermined amount of pressure in said third operative position of said operating means.

4. A sound proof device of a printer as defined in claim 1, wherein said sound proof block means includes an elongated block divided into a plurality of sections along its length.

5. A sound proof device of a printer is defined in claim 1, wherein said sound proof block means is made of a synthetic resin.

* * * * *